US006882820B2

(12) United States Patent
Shinshi et al.

(10) Patent No.: US 6,882,820 B2
(45) Date of Patent: Apr. 19, 2005

(54) FIXING DEVICE AND IMAGE FORMING APPARATUS INCLUDING THE SAME

(75) Inventors: Akira Shinshi, Chiba (JP); Naoki Iwaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/448,407

(22) Filed: May 30, 2003

(65) Prior Publication Data

US 2004/0013453 A1 Jan. 22, 2004

(30) Foreign Application Priority Data

May 31, 2002 (JP) ..... 2002-158629
Aug. 9, 2002 (JP) ..... 2002-233172
Apr. 16, 2003 (JP) ..... 2003-111382

(51) Int. Cl.[7] ..... G03G 15/20
(52) U.S. Cl. ..... 399/328; 399/68
(58) Field of Search ..... 219/216; 399/45, 399/67, 68, 303, 304, 307, 312, 328, 329, 322, 323, 330, 331, 332, 388

(56) References Cited

U.S. PATENT DOCUMENTS 5,426,495 A 6/1995 Sawamura et al.
5,832,354 A 11/1998 Kouno et al.
5,915,147 A 6/1999 Kouno et al.
5,999,789 A 12/1999 Sawamura
6,169,871 B1 1/2001 Higaya
6,255,632 B1 7/2001 Yokoyama et al.
6,340,810 B1 1/2002 Yokoyama et al.
6,449,454 B1 * 9/2002 Ito ..... 399/303

FOREIGN PATENT DOCUMENTS

JP 61-150364 9/1986
JP 61-205968 9/1986
JP 5-224546 9/1993
JP 6-3988 1/1994
JP 6-11985 1/1994
JP 7-175356 7/1995
JP 9-114289 5/1997
JP 2001-318544 11/2001

* cited by examiner

*Primary Examiner*—Ngo Hoang
(74) *Attorney, Agent, or Firm*—Oblon, Spivak, McClelland, Maier & Neustadt, P.C.

(57) ABSTRACT

A fixing device for an image forming apparatus of the present invention includes fixing roller and a pressing belt forming a nip therebetween. The fixing belt is passed over a drive roller and a driven roller and formed of a nonconductive material. A charge roller applies a charge opposite in polarity to a toner image carried on a sheet to the pressing belt from the outside surface of the belt. On contacting the pressing belt, the sheet is polarized with the result that a force attracting it toward the pressing belt increases. The sheet is therefore conveyed via the nip while being attracted by the belt 19 and does not or substantially does not wrap around the fixing roller.

101 Claims, 7 Drawing Sheets

FIXING DEVICE AND IMAGE FORMING APPARATUS INCLUDING THE SAME

BACKGROUND OF THE INVENTION

1. Field of the Invention

The present invention relates to a method and an apparatus for fixing a toner image on a sheet or recording medium and a copier, printer, facsimile apparatus, plotter or similar image forming apparatus including the same.

2. Description of the Background Art

It is a common practice with an image forming apparatus to form a latent image on an image carrier in accordance with image data, develop the latent image with a developing device to thereby produce a corresponding toner image, transfer the toner image from the image carrier to a sheet, and then fix the toner image on the sheet with a fixing device. One of conventional fixing devices is constructed such that a pair of rotatable members nip the sheet carrying the toner image thereon and fix the toner image with heat and pressure while conveying the sheet. This kind of fixing device is disclosed in, e.g., Japanese Utility Model Publication No. 4-3873 and Japanese Patent Laid-Open Publication Nos. 5-224546, 6-3988, 7-175356, 9-114289 and 2000-19866.

The problem with the fixing device described above is that the sheet is apt to wrap around the rotary members.

Technologies relating to the present invention are also disclosed in, e.g., Japanese Utility Model Publication No. 4-3320 and Japanese Patent Laid-Open Publication Nos. 6-11985 and 2001-318544.

SUMMARY OF THE INVENTION

It is an object of the present invention to provide a fixing method capable of preventing a sheet from wrapping around a rotatable member with high accuracy, a developing device for practicing the fixing method, and an image forming apparatus including the same.

A fixing device for fixing a toner image carried on a sheet-like recording medium of the present invention includes a pair of rotatable members facing each other for fixing the toner image on the recording medium by nipping and conveying the recording medium via a nip thereof. One of the rotatable members is positioned at a non-fixing side and contacts the non-image surface of the recording medium while the other rotatable member is positioned at a fixing side and faces the rotatable member positioned at the non-fixing side. A charging device applies a charge to the rotatable member positioned at the non-fixing side to thereby cause the recording medium to be attracted toward the rotatable member positioned at the non-fixing side by an electrostatic force.

An image forming apparatus including the above fixing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described hereinafter.

First Embodiment

Figure 1:
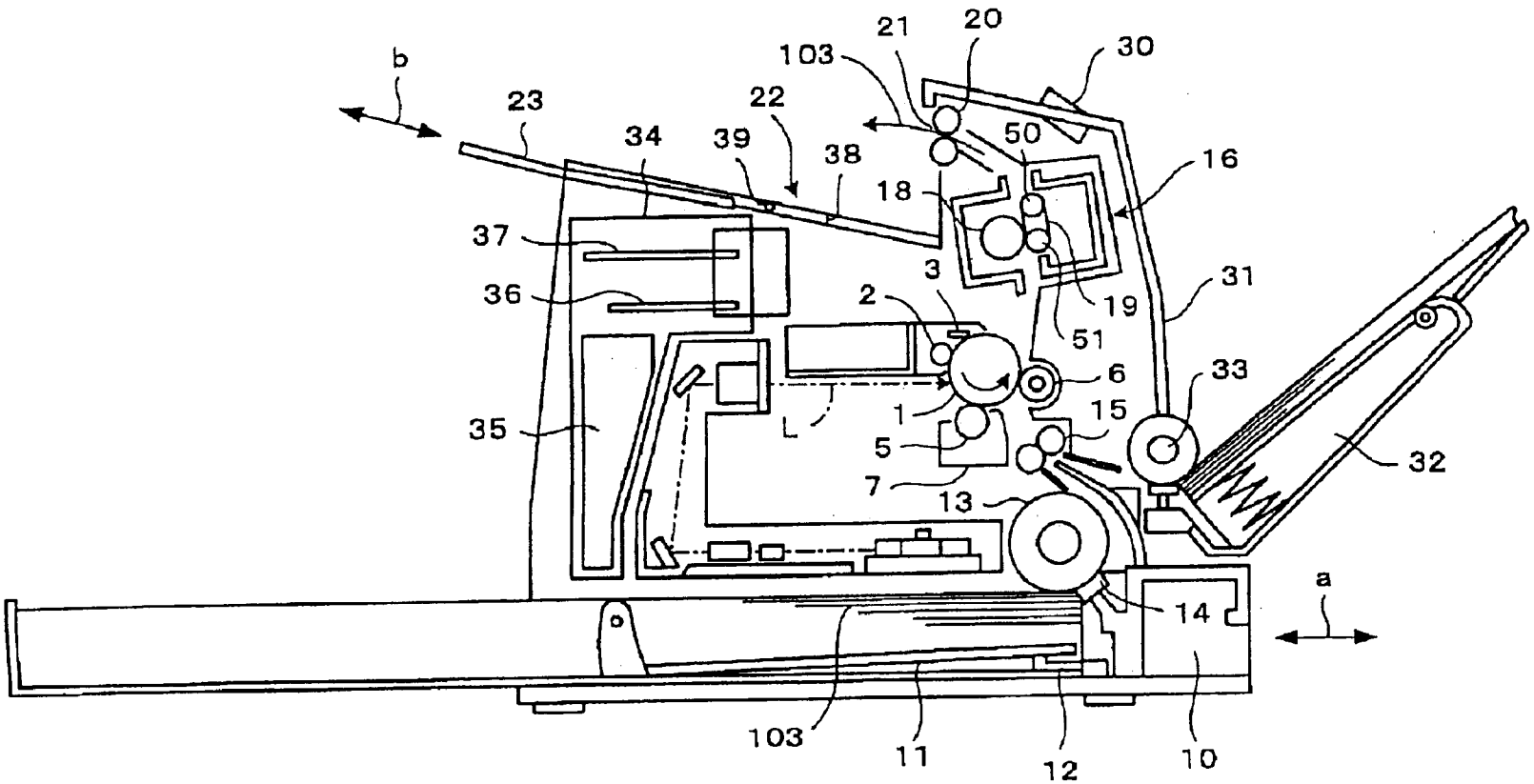
FIG. 1 is a view showing a first embodiment of the image forming apparatus in accordance with the present invention.

Referring to FIG. 1 of the drawings, an image forming apparatus embodying the present invention is shown and includes a photoconductive drum or image carrier 1 rotatable counterclockwise, as indicated by an arrow. Charging means 2, cleaning means 3, laser optics represented by a laser beam L, developing means 7 and image transferring means 6 are arranged around the drum 1. The developing means 7 includes a developing sleeve 5 for developing a latent image formed on the drum 1 with toner.

A sheet cassette 10 is disposed in the lower portion of the apparatus and can be mounted or dismounted in a direction indicated by an arrow a, as desired. Sheets 103 are stacked on a bottom plate 11 included in the sheet cassette 10 and are pressed against a pickup roller 13 by a spring, not shown, via an arm 12. When the pickup roller 13 is rotated in response to a command output from control means 37, which will be described later, the pickup roller 13 pays out the top sheet 103 toward a registration roller pair 15. At this instant, a pad 14 prevents two or more sheets 103 from being fed together. The registration roller pair 15 once stops the sheet 103 and then drives the sheet at such timing that the leading edge of the sheet 103 meets the leading edge of a toner image formed on the drum 1.

After the toner image has been transferred from the drum 1 to the sheet 103, the sheet 103 is conveyed to a fixing device 16 including a fixing roller 18 and an endless, pressing belt (simply belt hereinafter) 19, which are held in contact with each other. The belt 19 constitutes one rotatable member positioned at the non-fixing side and plays the role of a conveying member at the same time while the fixing roller 18 constitutes the other rotatable member positioned at the fixing side. The sheet 103 with the toner image is conveyed via the nip between the fixing roller 18 and the belt 19 while having the toner image fixed thereon by heat and pressure. It should be noted that the belt 19 of the illustrative embodiment covers both of a fixing belt to be heated and a belt used for pressing.

The sheet 103, come out of the fixing device 16, is driven out of the apparatus by an outlet roller pair 20 via an outlet 21 and stacked on a tray 22 face down. A stop plate 23 is slidable in a direction indicated by an arrow b in order to cope with various sheet sizes.

A control panel 30 protrudes from the front top surface of a frame 31, as shown in FIG. 1. A manual feed tray 32 is hinged to the frame 31 via a pin 33. A case 34 is positioned in the right portion of the frame 31, as viewed in FIG. 1, and accommodates a power supply 35, a printed circuit board or engine driver board 36 and so forth as well as the control means or controller board 37.

A cover 38, constituting the tray 22, is openable about a fulcrum 39. In FIG. 1, part of the fixing device 16 is not shown.

Figure 12:
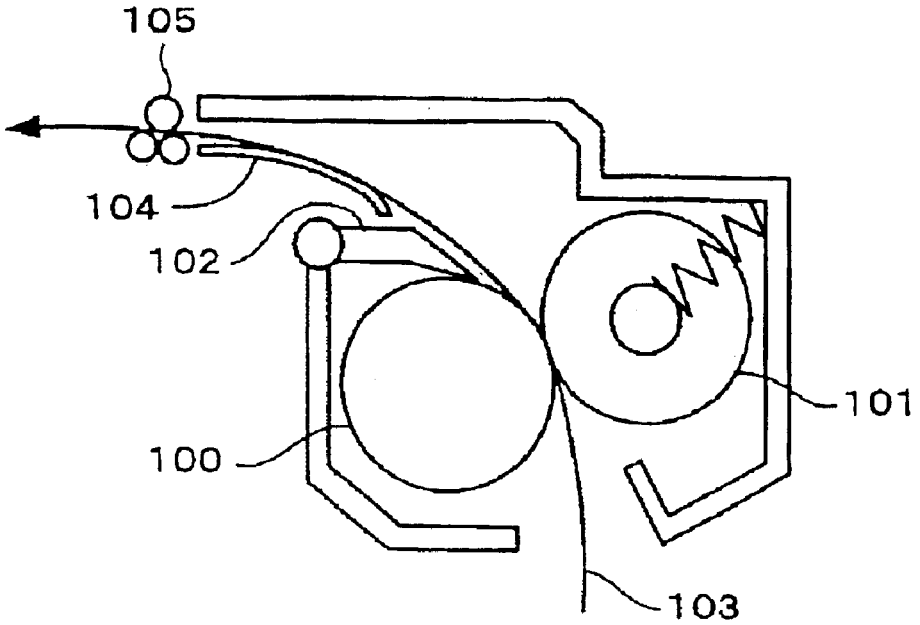
FIG. 12 shows the basic configuration of the fixing device of the present invention.

To better understand the fixing device 16 of the illustrative embodiment, some conventional developing devices will be described hereinafter. FIG. 12 shows a fixing device including a heat roller 100 provided with a heat source, a press roller 101 pressed-against the heat roller 100, and a peeler 102 held in contact with the heat roller 100. A sheet 103, carrying the toner image thereon, is conveyed via the nip between the heat roller 100 in such a position that the toner image contacts the heat roller 100. As a result, the toner of the toner image is melted by heat and pressure and fixed on the sheet 103.

The peeler 102 forcibly separates the sheet 103 from the heat roller 100 in order to prevent the sheet 103 from wrapping around the heat roller 100 due to the adhesion of the melted toner. In practice, the peeler 102 is implemented as a plurality of peelers spaced from each other in the axial direction of the heat roller 100. The sheet 103 thus separated by the peeler 102 is driven out by an outlet roller pair 105 while being guided by a guide member 104. As for such a forcible separation system, there are also available a so-called air knife system configured to jet compressed air toward the leading edge of the sheet 103 and a semi-forcible system using a separating plate spaced from the heat roller 100.

Apart from a heat roller system in which two rollers are pressed against each other, as stated above, there may be used a belt fixing system in which a press roller is pressed against a heated endless belt.

The problem with any one of the conventional fixing systems described above, particularly the heat roller system, is that offset is apt to occur, i.e., the toner is apt to deposit on the fixing roller (heat roller 100), resulting in a defective image. To solve this problem, Laid-Open Publication Nos. 6-3988 and 7-175356 mentioned earlier each propose to apply a bias to the fixing roller for obviating offset. Also, Laid-Open Publication Nos. 5-224546 and 9-114289 each propose to apply a bias opposite in polarity to toner from the inside of the press roller.

While the peeler system, which is a specific separation system, is often used because of its simple configuration, it has a problem that the peeler is held in contact with the surface of the roller or that of the belt over a long time, causing the deterioration of the above surface to effect durability. Further, the peeler rubs the image surface to thereby bring about image defects. Moreover, toner accumulates on the peeler little by little and is apt to render separation defective, causing the. sheet to jam the fixing device. The air knife system is undesirable from the noise, cost and space requirement standpoint.

The system that applies a bias to the fixing roller (heat roller) is capable of preventing toner offset, but is not satisfactory when it comes to the separation of a sheet for the following reasons. Generally, margins are present on a sheet outside of an image area. An electrostatic repulsive force for obviating offset does not act at the leading edge margin where toner with polarity is absent, so that the leading edge margin curls along the surface of the fixing roller due to heat. Consequently, the leading edge portion of the sheet is likely to adhere to the surface of the fixing roller and gets under the peeler, depending on the degree of adhesion.

The system that applies a voltage from the inside of the press roller (core) is effective from the toner offset standpoint because the thickness from the charging position to the surface layer is great. However, this system cannot satisfactory promote the separation of a sheet. This is because an electrostatic force intense enough to separate a sheet from the fixing roller is not available at least at the leading edge margin of the sheet, so that the leading edge portion of the sheet curls along the surface of the fixing roller.

Figure 2:
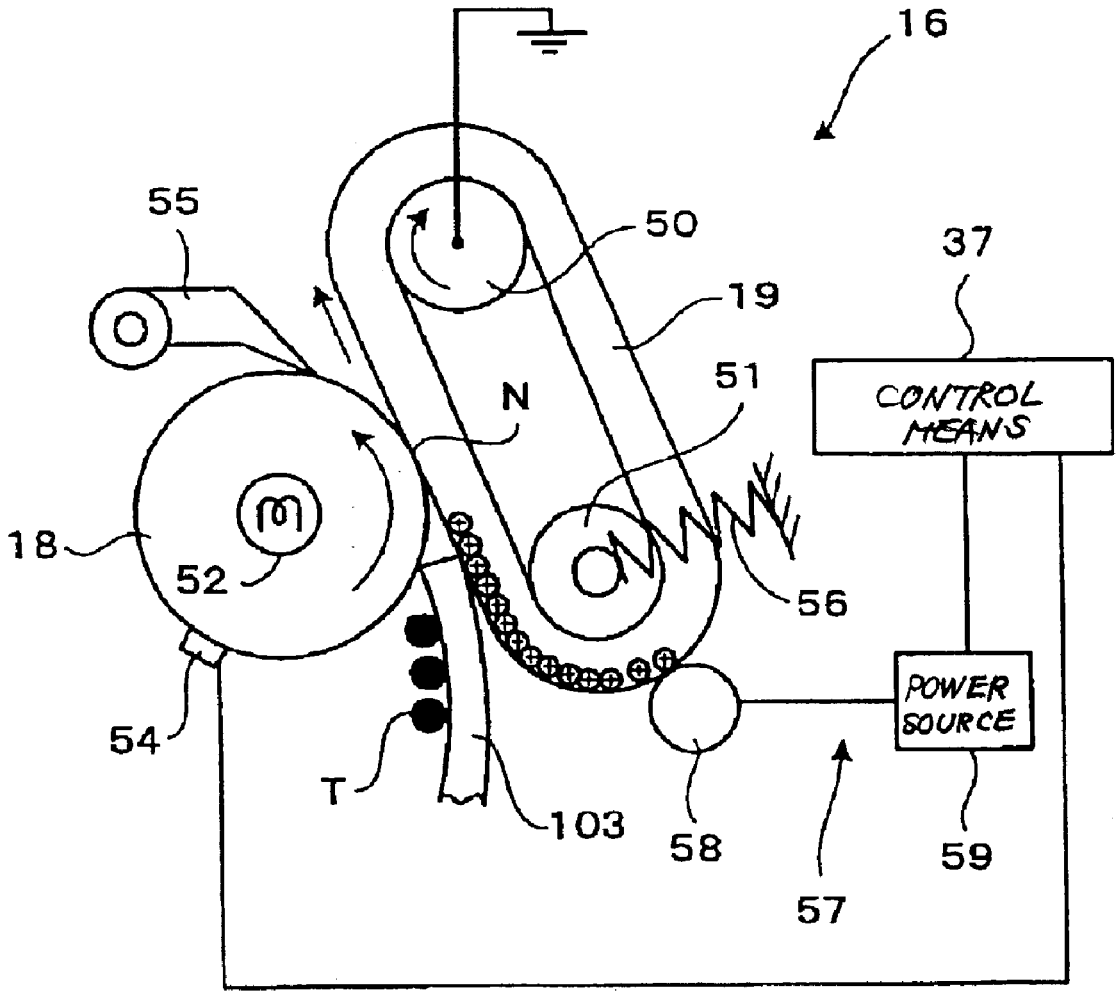
FIG. 2 shows a fixing device included in the first embodiment in a condition wherein a sheet reached a position just preceding a nip.

The fixing device 16 of the illustrative embodiment is constructed to solve the problems described above. Reference will be made to FIG. 2 for describing the fixing device 16 in detail. As shown, the fixing roller accommodates a halogen heater or heat source 52 and will be referred to as a heat roller hereinafter. A thermistor or temperature sensing means 54 is mounted on the outer surface of the heat roller 18. Information representative of temperature is sent from the thermistor 54 to the control means 37. The controller means 37 controls power supply to the halogen heater 52 in accordance with the above information. The control means 37 refers to a microcomputer including a CPU (Central Processing Unit), a ROM (Read Only Memory), RAM (Random Access Memory), and an I/O (Input/Output) interface.

A peeler 55 is positioned downstream of the nip N between the heat roller 18 and the belt 19 in the direction of sheet conveyance in order to separate the sheet 103. The belt 19 has a 200 $\mu$m thick surface layer formed of nonconductive polyimide and is passed over a drive roller 50 and a driven roller 51. The belt 19 is positioned such that one of its opposite runs extends via the nip N. The drive roller 50 is grounded. The driven roller 51 is constantly biased toward the heat roller 18 by a spring 56, pressing the belt 19 against the heat roller 18 to form the nip N.

Charging means 57 charges the belt 19 at the outside of the loop of the belt 19, efficiently intensifying attraction to act on the sheet 103. The charging means 57 includes a charge roller 58 contacting the outer surface of the belt 19 and a power source 59 whose output voltage is variable under the control of the control means 37. The charging means 57 bifunctions as electrostatic attraction applying means for applying an electrostatic attracting force to one of two rotatable members or a sheet or recording medium.

In the illustrative embodiment, a charge opposite in polarity to toner T is deposited on the belt 19 from the outer surface side of the belt 19. When the sheet 103 arrives at a position preceding the nip N, even its leading edge margin where the toner T is absent is electrostatically attracted by the belt 19 and can therefore enter the nip N without fluttering or jamming the path. In this manner, the charge is applied to cause the electrostatic force to start acting at a position close to the inlet of the nip N. Because the charge deposited on the belt 19 is opposite in polarity to the toner T, the toner image is prevented from being scattered or otherwise disturbed due to an electrostatic repulsive force at the position preceding the nip N.

Stated another way, the sheet 103 is caused to electrostatically adhere to part of the surface of the belt or one rotatable member 19, which is positioned at the non-fixing side (surface contacting the heat roller 18 or conveying the sheet 103), extending from the side upstream of the nip N to the side downstream of the same. This part of the belt 19 is linear and therefore substantially flat. It is to be noted that the term "substantially flat surface" covers a flat surface, a slightly concave surface, and a slightly convex surface.

In Utility Model Publication No. 4-3873, part of a belt that extends from the side upstream of a nip to the side downstream of the same is convex with a large curvature. By contrast, the same part of the belt 19 of the illustrative embodiment is substantially flat, as stated above, and allows the sheet 103 to easily follow the surface of the belt 19. This successfully protects the toner image from disturbance ascribable to the fluttering of the sheet 103.

On the other hand, at the side downstream of the nip N, the sheet 103 easily follows the belt 19 and can be prevented from wrapping around the heat roller 18. Even when only the part of the belt 19 downstream of the nip N is substantially flat, the sheet 103 can be separated more easily than in the configuration taught in Utility Model Publication No. 4-3873.

Figure 3:
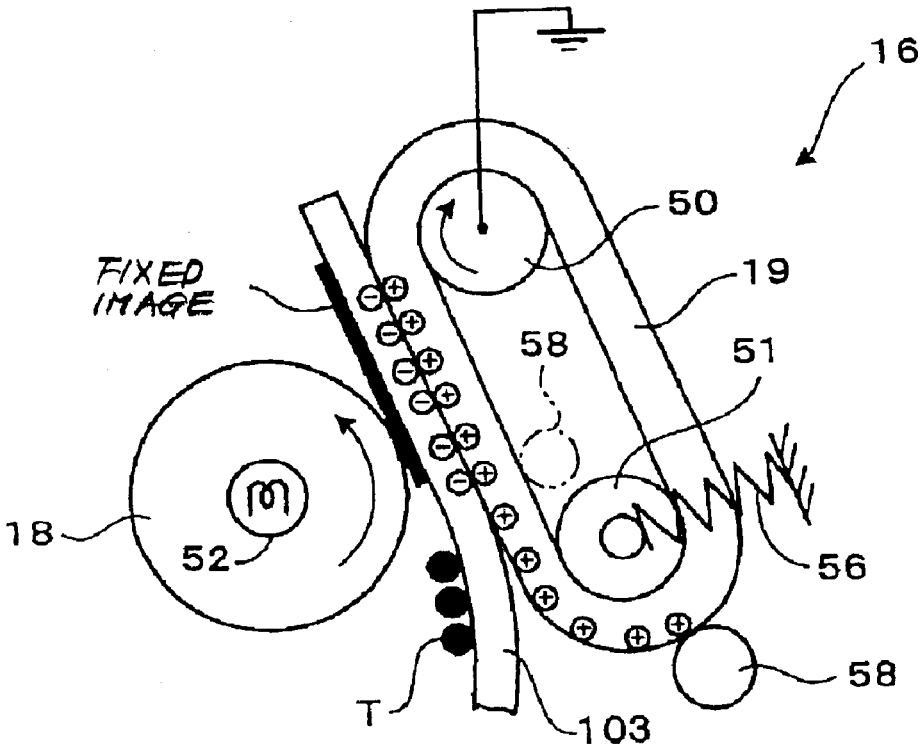
FIG. 3 is a view similar to FIG. 2, showing a condition wherein fixation is partly ended.

As shown in FIG. 3, the belt 19 is uniformly charged while in movement. The charge voltage should preferably be as high as 1,000 V to 5,000 V. When the sheet 103 is brought into contact with the belt 19, the force causing the sheet 103 to adhere to the belt 19 increases due to polarization. The sheet 103, passing the nip N while adhering to the belt 19, wraps around the heat roller 18 little, so that pressure with which the peeler 55 contacts the heat roller 18 can be lowered. The peeler 55 may even be omitted, depending on the degree of the voltage applied. More specifically, because the voltage of the charging means is so selected as to implement an electrostatic force that separates a recording medium from the rotatable member positioned at the fixing side, the peeler or similar separating member can be omitted in order to simplify the construction and enhance the durability of the above rotatable member. Further, because the voltage of the charging means is so selected as to reduce the contact pressure of the separating member, the durability of the rotatable member at the fixing side is enhanced.

The voltage applied to the charging means 57 may be freely selected within a range of from a level that allows the contact pressure of the peeler 55 to be reduced to a level that prevents the sheet 103 from wrapping around the heat roller 18 even when the peeler 55 is absent. How easily the sheet 103 can be separated from the heat roller 18 and from the belt 19 depends on the kind of the sheet 103 including material, flexibility, thickness and size, so that the level of the above voltage must be adjusted in accordance with the kind of the sheet 103. Also, an optimum voltage should preferably be selected from the energy saving standpoint.

In the illustrative embodiment, data representative of the optimum relation between the kind of the sheet 103 and the voltage are obtained by experiments or computer simulations beforehand. A data table, listing the above data, is stored in, e.g., the ROM of the control means 37. The control means 37 identifies the kind of the sheet 103 on the basis of information input on the control panel, information output from a sensor, not shown, or information received from a host personal computer or similar external terminal. The control means 37 then selects an optimum voltage out of the data table on the basis of the kind of the sheet 103 and controls the power source 59 accordingly. This obviates troubles ascribable to the kind of the sheet 103, enhances the separation of the sheet 103, and contributes to energy saving. Further, because the rotatable member at the non-fixing side is an endless belt, there can be enhanced the charging efficiency and therefore the separation of the sheet 103. As stated above, the control means 37 plays the role of varying means for varying the electrostatic attracting force.

EXAMPLE 1

In a specific example of the illustrative embodiment, a voltage of 2,000 V was applied to the belt 19. The surface potential of the belt 19 at the side downstream of the nip N was maintained at about 1,700 V. In this condition, even when a thin sheet, carrying toner over substantially the entire surface thereof and tending to wrap around, was used, the sheet moved away from the nip N was attracted by the belt 19, so that the peeler 55 or similar separating means was not necessary. This is presumably because the belt 19 extends in the direction in which the sheet 103 moves, and therefore the surface potential of 1,700 V sufficiently functions in the region downstream of the nip N.

EXAMPLE 2

In another specific example, voltages of 1,000 V and 1,500 V were applied. In this case, although the sheet 103 was attracted by the belt 19 to a separable degree, depending on the kind of the sheet 103, the sheet 103 remained on the heat roller 18 when a thin sheet was used in the same condition as in Example 1.

While the illustrative embodiment charges the belt 19 at the outside of the loop of the belt 19, the belt 19 may be charged from the inside of the loop by a charge roller 58 if the belt 19 is thin, as indicated by a phantom line in FIG. 3. This configuration enhances the charging efficiency and therefore the separation of the sheet 103. Stated another way, the belt or one rotatable member 19 has an outer surface facing the heat roller or the other rotatable member 18 and an inner surface facing the center of rotation of the belt 19. In this sense, the electrostatic attraction applying means applies the attracting force to the inner surface of the belt 19.

If desired, the driven roller 51 may be implemented as an electrode for charging the belt 19. Of course, the charge roller 58 may be replaced with a charge brush or a scorotron charger; whether such a charge electrode contacts or does not contact the belt 19 is not an issue. While the rotatable members at the fixing side and non-fixing side are implemented as a roller and a belt in the illustrative embodiment, use may be made of the combination of rollers, the combination of a belt and a roller or the combination of belts.

Second Embodiment

In the illustrative embodiment, the control means or varying means 37 varies the electrostatic attracting force in accordance with the amount, the area or the thickness of the toner image carried on the sheet 103. Data representative of the optimum relation between the above amount, area or thickness and the voltage are obtained by experiments or computer simulations beforehand and stored in the memory of the control means 37, as in the previous embodiment. The control means 37 recognizes the amount, the area or the thickness of the toner image carried on the sheet 103 received from an image processing device, not shown, selects an optimum voltage out of the data table, and then controls the power source 59.

Third Embodiment

Figure 4:
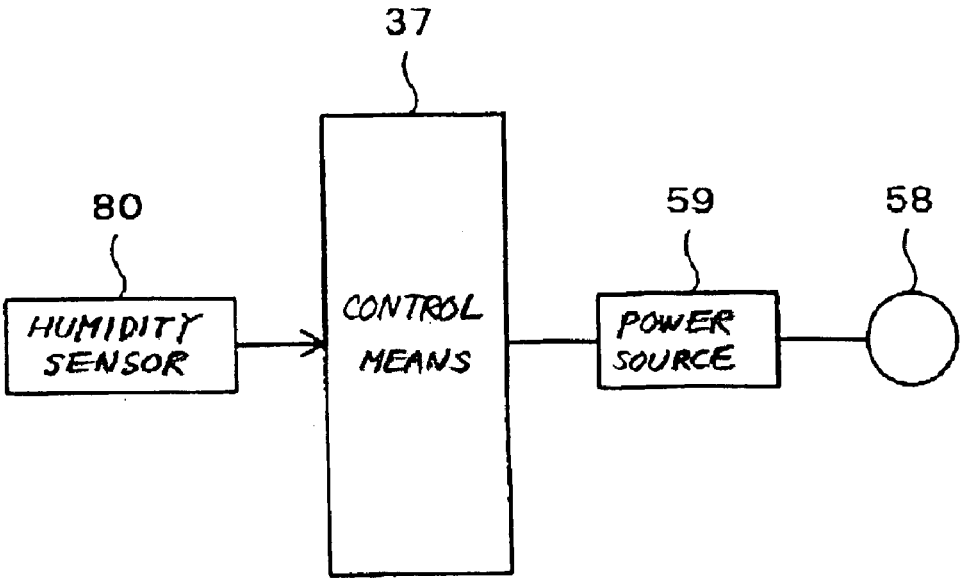
FIG. 4 is a block diagram schematically showing a control system representative of a third embodiment of the present invention.

FIG. 4 shows a third embodiment of the present invention. In the third embodiment, structural elements identical with those of the previous embodiments are designated by identical reference numerals and will not be described specifically in order to avoid redundancy. This is also true with other embodiments to follow.

As shown in FIG. 4, a humidity sensor or humidity sensing means 80 senses humidity and sends its output to the control means or varying means 37. This configuration is used to prevent the electrostatic attracting force from varying in consideration of the fact that the chargeability and curl of the sheet 103 vary in accordance with humidity.

Data representative of the optimum relation between humidity and the voltage is obtained by experiments or computer simulations beforehand and stored in the memory of the control means 37 in the form of a data table. The control means 37 selects an optimum voltage out of the data table in accordance with information received from the humidity sensor 80 and controls the power source 59.

Fourth Embodiment

Figure 5:
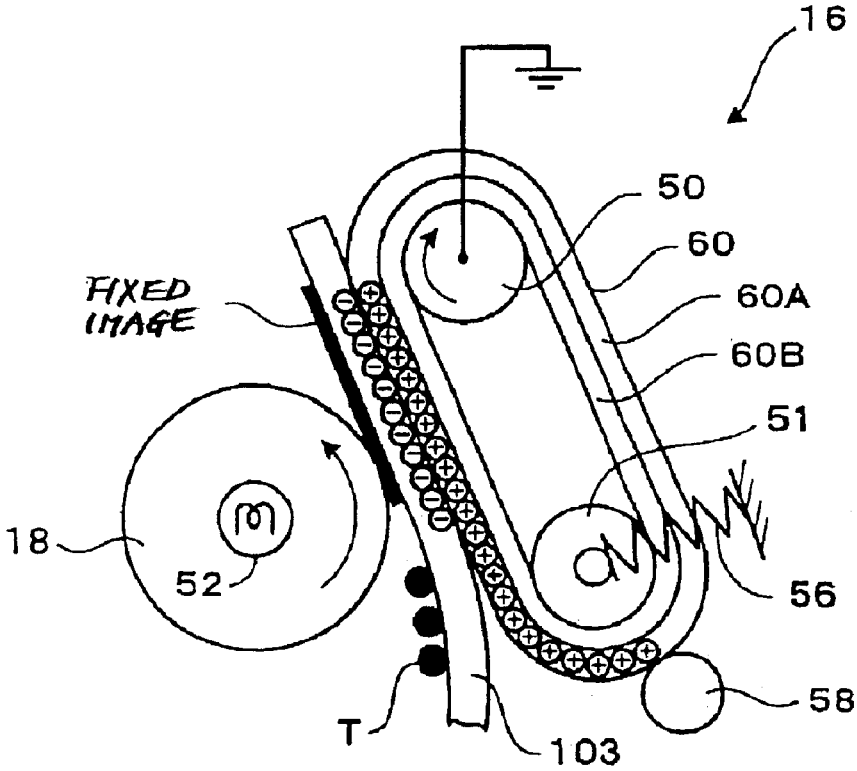
FIG. 5 shows a fourth embodiment of the present invention in a condition wherein fixation is partly ended.

FIG. 5 shows a fourth embodiment of the present invention. As shown, a belt 60 is made up of a conductive inner layer or conductive portion 60B and a nonconductive outer layer or nonconductive portion 60A. The nonconductive layer 60A faces the heat roller 18. The inner layer 60B and outer layer 60A are electrically insulated from each other.

When the charge roller 58 charges the belt 60, a charge is deposited on both of the outer layer 60A and inner layer 60B. The charge of the inner layer 60B, which is conductive, freely migrates and charges the surface layer 60A. As a result, the charge potential of the surface layer 60A is increased, increasing the attracting force to act on the sheet 103 and therefore promoting the separation of the sheet 103. The charge of the inner layer 60B is discharged at the side close to the drive roller 50, weakening the adhesion of the sheet 103 to the belt 60.

Fifth Embodiment

Figure 6:
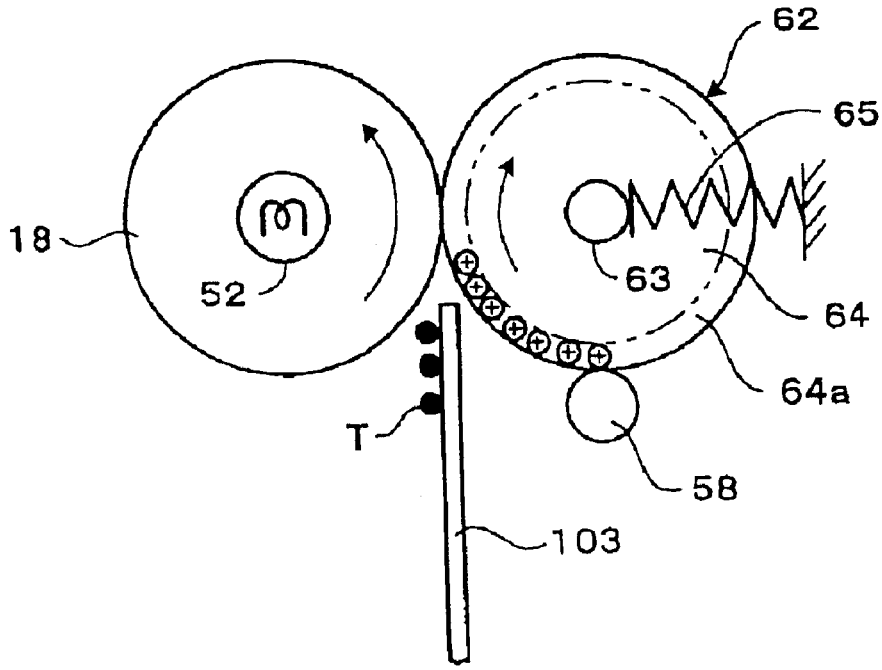
FIG. 6 shows a fifth embodiment of the present invention including a press roller.

Referring to FIG. 6, a fifth embodiment of the present invention includes a press roller or one rotatable member 62 pressed against the heat roller 18 in place of the belt 19. The press roller 62 is made up of a metallic core 63 and an elastic nonconductive layer 64 and pressed against the heat roller 18 by a spring 65. The charge roller 58, adjoining the surface of the press roller 62, charges the press roller 62, so that only the surface portion 64*a* of the nonconductive layer 64 is efficiently charged without regard to the thickness of the layer 64. This embodiment also implements the separation of sheet as efficiently as the previous embodiments.

The belt scheme is superior to the roller scheme because the roller has a larger curvature than the belt around the nip N and therefore weakens the electrostatic attracting force to act on the sheet 103.

EXAMPLE 3

In a specific example of the illustrative embodiment, the charge voltage applied to the press roller 62 was increased from 1,000 V by a step of 500 V. When the charge voltage was increased to 3,000 V, the surface potential of the press roller 62 was measured to be 2,500 V at the side downstream of the nip N. In this case, although the sheet 103 was attracted to such a degree that it could be separated from the heat roller 18, the sheet 103 remained on the latter in the previously stated condition in which the sheet 103 was apt to adhere to the heat roller 18.

Why the surface potential of the press roller 62 was higher than the surface potential of the belt 19 is presumably that the surface of the press roller 62 moves away from the heat roller 18 at the side downstream of the nip N, causing an electric field downstream of the nip N to fail to sufficiently function. Although the electric field functions more easily as the curvature of the press roller 62 increases, the same condition described in relation to the belt 19 is not achievable unless the press roller 62 is provided with an extremely large diameter, making the fixing device impractical.

If the inner surface of the surface portion 64*a* is made conductive and if the core 63 is grounded as in the fourth embodiment, then the function described above is achievable. In FIG. 6, part of the charging means 57 is not shown.

In the illustrative embodiments described so far, the drive side and driven side and the pressing side and pressed side are replaceable each.

In Examples 2 and 3, although sure separation was not achieved, three sheets passed without any voltage being applied all were found to wrap around the heat roller 18. This suggests that a force tending to separate the sheet acts even in Examples 2 and 3. In light of this, we examined whether or not the problems of the conventional separating members could be solved under the above condition. Experiments showed that when the surface potential of the press roller 62 or that of the belt 19 downstream of the nip N was 1,500 V, the force causing the sheet to adhere to the heat roller 18 was extremely weak.

The function required of the separating member in the above condition is not more than to cause separation to start. Once separation starts, the separating force derived from attraction continues in the region to follow and allows the sheet to be conveyed in such a manner as to move away from the heat roller 18.

Separating means are generally divided into contact type of separating means contacting the heat roller 18 and non-contact type of separating means spaced from the heat roller 18 by a small gap. As for the non-contact type of separating means, if toner is absent at the leading edge portion of the sheet, i.e., if a margin is provided at the leading edge portion, then it is possible to surely prevent the leading edge of the sheet, which is attracted by the press roller 62 or the belt 19, from entering the above gap. Even if the portion of the sheet following the leading edge portion adheres to the heat roller 18, the above portion does not enter the gap because a force, tending to move it away from the heat roller 18, acts due to the electric field.

As for the contact type of separating means, only if the leading edge of the sheet is lightly caused to start parting from the heat roller 18, the force, tending to move the sheet away from the heat roller 18 acts thereafter, realizing sure separation. The conventional contact type peeler is required to separate the sheet adhered to the heat roller alone and should therefore be pressed against the heat roller by a force that overcomes the adhesion of the sheet, causing peeler marks to appear in an image or scratching the heat roller. By contrast, in accordance with the present invention, the peeler 55 should only be biased by an extremely weak force. It was experimentally found that while a bias required of the conventional peeler was 20 gf or so, a bias required of the peeler 55 was as small as 10 gf or so.

Although Experiments 1 and 3 basically do not need the separating member, they may include it for the safety purpose.

As for the charging system, the charge may be applied from either one of the inner surface and outer surface. However, when the charge is applied from the inner surface and if a rubber layer or similar nonconductive layer is present at the pressing side and relatively thick, then resistance increases and brings about a voltage drop for the voltage applied. As a result, the surface potential and therefore the force attracting the sheet decreases. It follows that a lower charge potential implements the above force when the charge is applied from the outer surface than when it is applied from the inner surface.

Sixth Embodiment

A sixth embodiment of the present invention will be described with reference to FIG. 7. In the embodiments described so far, the charging means applies a charge to the rotatable member located at the non-fixing side, so that the resulting polarization of the sheet or recording medium generates an electrostatic attracting force that attracts the sheet toward the rotatable member. In practice, however, the electrostatic attracting force derived from polarization is limited and may fail to overcome the adhering force of toner.

In light of the above, the illustrative embodiment positively applies a charge opposite in polarity to the rotatable member at the non-fixing side to the sheet, thereby increasing a difference in potential between the sheet and the above rotatable member and therefore the attracting force.

Figure 7:
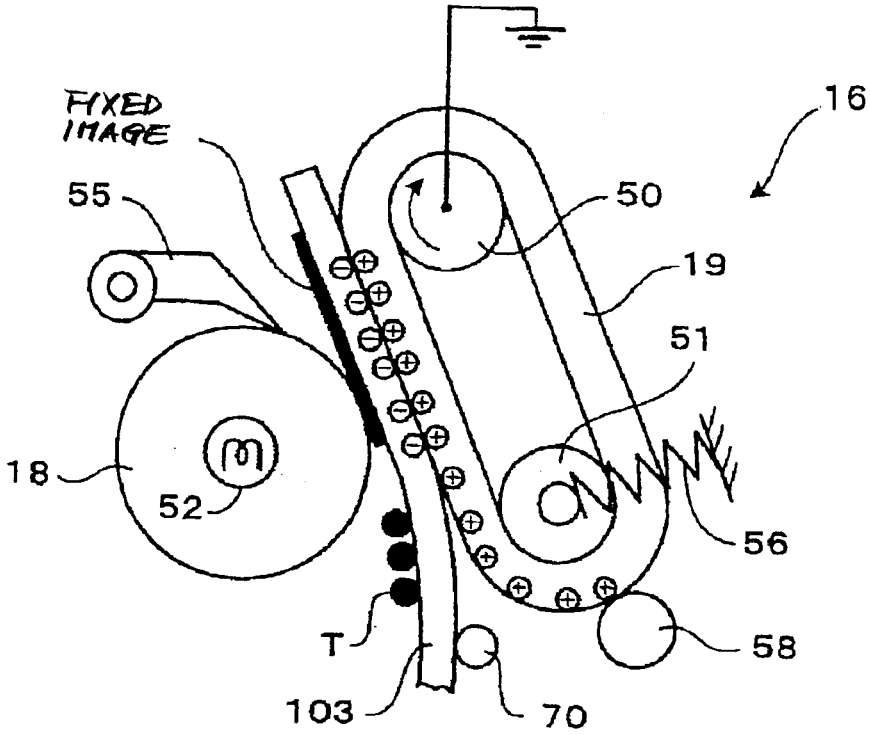
FIG. 7 shows a sixth embodiment of the present invention applying a charge of opposite polarity to a sheet.

As shown in FIG. 7, the illustrative embodiment is identical with the first embodiment as to basic configuration. The difference is that the illustrative embodiment includes a ground roller or conductive member 70 located to contact the non-image surface of the sheet 103 at a position upstream of the nip N. The ground roller 70 is a specific form of charge applying means for applying a charge to the sheet 103. In the illustrative embodiment, the charging applying means applies a charge opposite in polarity to the toner image of the sheet to the non-image surface of the sheet.

The ground roller 70 is grounded and capable of feeding free electrons to the sheet 103. When the sheet 103 is polarized, free electrons fed from the ground roller 70 migrate to the position where the sheet 103 contacts the belt 19, intensifying the charge and therefore the electrostatic attracting force. This is successful to prevent the sheet 103 from wrapping around the heat roller 18 with accuracy.

If desired, the ground roller 70 maybe replaced with charging means including a charge wire or a high-tension voltage generator. For example, when a voltage of −3 kV is applied to the belt 19 or similar rotatable member positioned at the non-fixing side, a voltage of +3 kV is applied to the sheet 103.

Although the ground roller 70, simply contacting the sheet 103, is inferior to the charging means as to the function of increasing the potential difference, the ground roller 70 does not need, e.g., a high-tension power source and is therefore simple and low cost. The ground roller 70 may be replaced with a guide member, brush or similar conductive member connected to ground.

Seventh Embodiment

Briefly, a seventh embodiment of the present invention does not include the electrostatic attraction applying means, but includes the charge applying means that charges the sheet or recording medium 103. The sheet 103 is therefore attracted toward the belt 19 only by the electrostatic force derived from the charge applied thereto. The charge applied to the sheet 103 forms a charge of opposite polarity on one rotatable member for thereby generating the electrostatic attracting force. In this case, if the charge applied to the sheet 103 is opposite in polarity to the toner image carried on the sheet 103, then the toner image is free from disturbance.

Figure 8:
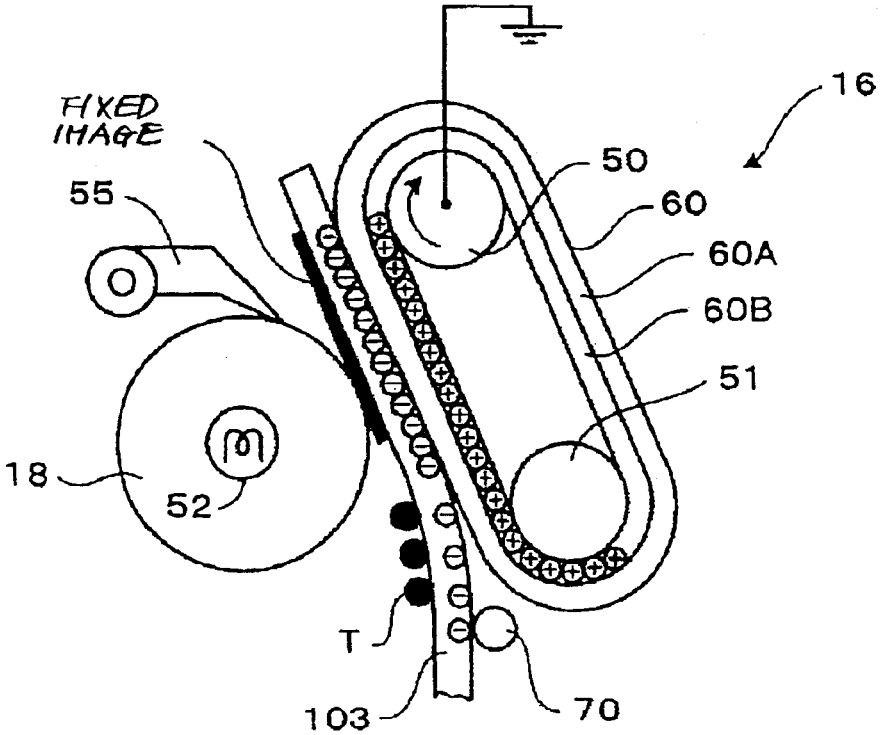
FIG. 8 shows a seventh embodiment of the present invention applying a charge of opposite polarity to a sheet.

More specifically, as shown in FIG. 8, the driven roller 51 is implemented as a charge roller for applying a charge to the inner surface of the belt 60, so that free electrons are fed from the ground roller 70 to the sheet 103. Alternatively, the surface layer of the heat roller 18 may be provided with conductivity and connected to ground, in which case the heat roller 18 itself will serve as a conductive member for feeding free electrons to the sheet 103. This alternative scheme prevents the sheet 103 from wrapping around the heat roller 18 with accuracy without resorting to any additional member.

Eighth Embodiment

Figure 9:
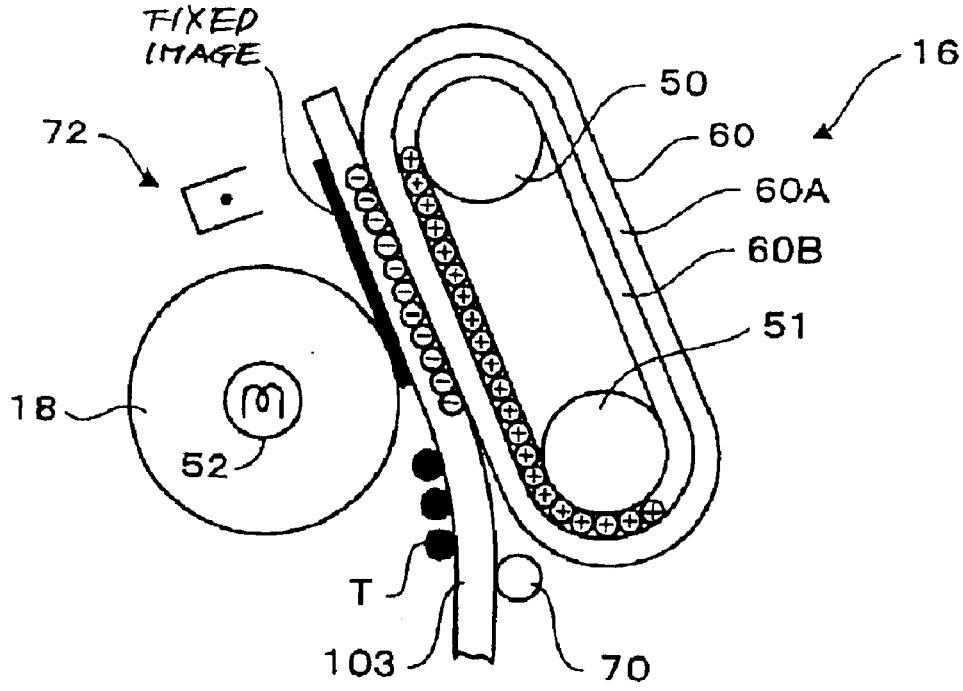
FIG. 9 shows an eighth embodiment of the present invention including peeling means located downstream of the nip.

FIG. 9 shows an eighth embodiment of the present invention configured to positively peel off the sheet 103 from the rotatable member positioned at the non-fixing side. As shown, peeling means 72 is positioned downstream of the nip N for electrostatically separating the sheet 103 from the belt 60. The peeling means 72 is implemented by a charge wire type of charger using corona discharge. The charger 72 discharges the sheet 103 so as to cause the electrostatic attracting force, which acts between the sheet 103 and the belt 60, to decrease or practically disappear. Consequently, the sheet 103 can be smoothly peeled off from the belt 60, which is the rotatable member located at the non-fixing side.

While the peeling means 72 is implemented as a non-contact type of charger, it may be implemented as a charge roller, charge brush or similar contact type of charger, if desired. Further, the peeling means, using the discharging system stated above, may be replaced with a charger configured to generate an electrostatic repulsive force between the recording medium and the rotatable member positioned at the non-fixing side, i.e., to apply a charge of the same polarity as the above rotatable member. Such a charger more surely prevents the sheet 103 from firmly adhering to the belt 60.

Ninth Embodiment

Figure 10:
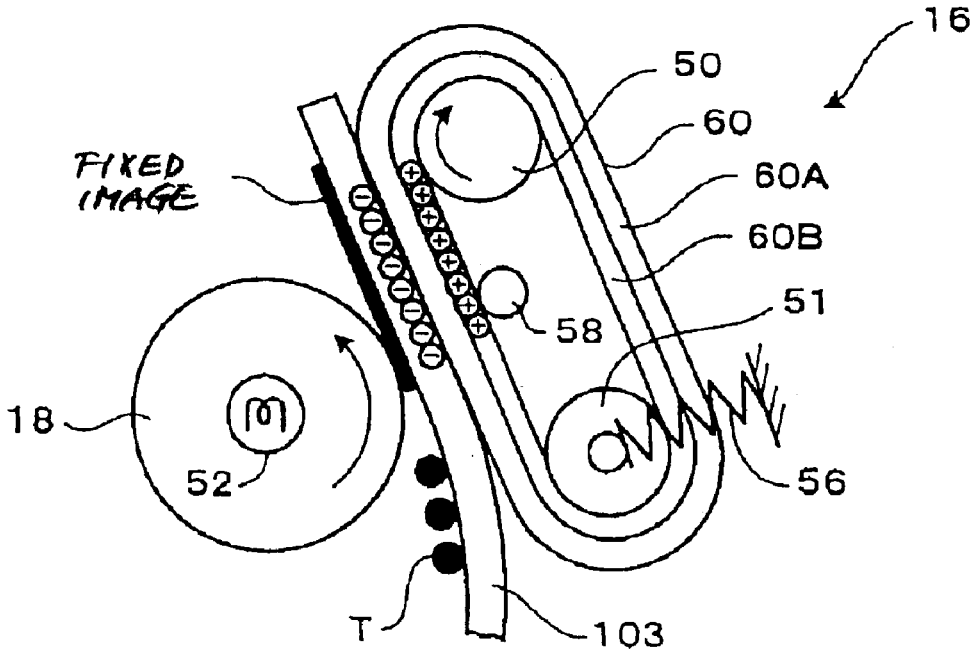
FIG. 10 shows a ninth embodiment of the present invention.

FIG. 10 shows a ninth embodiment of the present invention configured to protect the toner image of the sheet 103 from disturbance ascribable to the electrostatic force at the side upstream of the nip N. As shown, the electrostatic attraction applying means (charging means 57) is positioned at least downstream of the nip N of the belt 60. The charge roller 58 is located at a position substantially corresponding to the nip N. In this configuration, the sheet 103 is attracted toward the belt 60 at the position downstream of the nip N.

Tenth Embodiment

Figure 11:
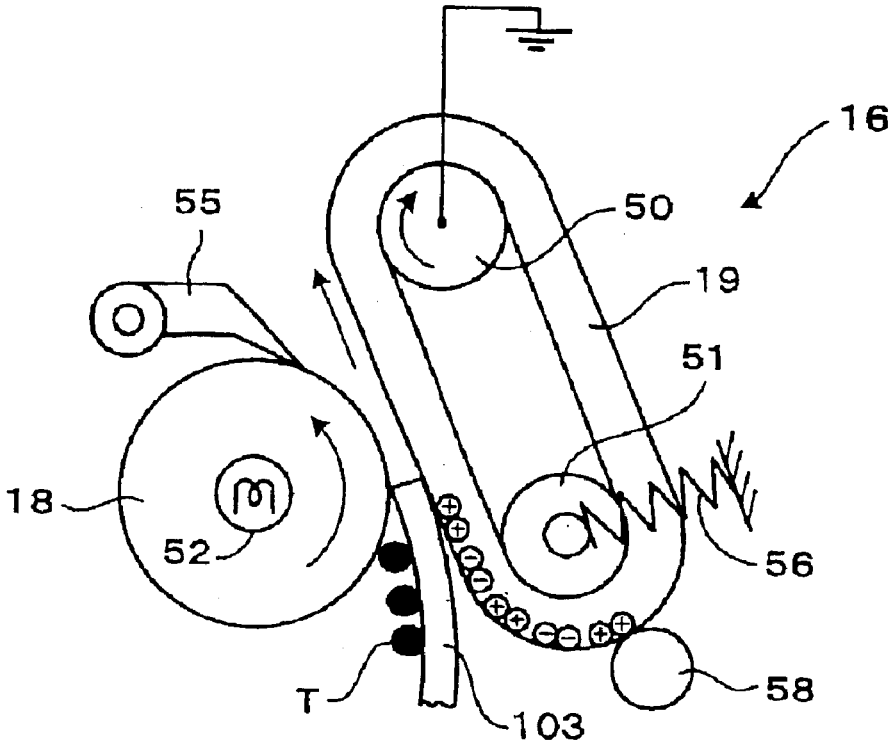
FIG. 11 shows a tenth embodiment of the present invention.

FIG. 11 shows a tenth embodiment of the present invention. When the electrostatic attraction applying means charges the sheet or recording medium 103, it is likely that a charge remains on the sheet 103 even after the sheet 103 has been separated from one rotatable member and causes the sheet 103 to jam the path around the outlet 21 or causes it to be defectively stacked outside the apparatus. This embodiment solves this problem.

More specifically, as shown in FIG. 11, the electrostatic attraction applying means (charging means 57) applies a charge or an uneven electric field to the belt or one rotatable member 19 via the charge roller 58. The uneven electric field is applied from the charge roller 58 to the belt 19 in the form of a stripe in the direction perpendicular to the direction of rotation. In this case, an uneven electric opposite in polarity to the belt 19 is formed on the reverse surface or non-image surface of the sheet 103. Therefore, after the sheet 103 has been separated from the belt 19, the charge easily migrates within the sheet 103 and neutralizes the uneven electric field. This prevents the sheet 103 from jamming the sheet around the outlet 21 or being defectively stacked outside the apparatus.

The uneven electric field stated above may be similarly applied to the other embodiments including the electrostatic attraction applying means.

In any one of the embodiments shown and described and configured to apply a charge to one rotatable member with the electrostatic attraction applying means, the electrostatic attraction applying means may apply the charge to the sheet 103. In such a case, a charge of opposite polarity is formed on one rotatable member, so that the electrostatic attracting force can also be achieved.

While the non-image surface of the sheet 103 has been shown and described as being attracted toward the surface of one rotatable member, the image surface of the sheet 103 may alternatively be attracted toward the same. Even in this configuration, the toner image of the sheet 103 is protected from disturbance if a charge of the same polarity as the toner image is applied to one rotatable member. Further, even when the sheet 103 carries toner images on both sides thereof, the electrostatic attraction applying means or the charge applying means may apply the charge to the sheet for thereby implementing electrostatic attraction.

In the illustrative embodiments, when a cover, not shown, forming part of the frame 31, FIG. 1, is opened to, e.g., remove a jamming sheet, a switch, not shown, automatically turns off high-tension power sources assigned to the charging means and charger for the safety purpose.

In summary, in accordance with the present invention, a recording medium is attracted toward a rotatable member positioned at the non-fixing side by an electrostatic force and therefore substantially prevented from wrapping around a rotatable member positioned at the fixing side.

Various modifications will become possible for those skilled in the art after receiving the teachings of the present disclosure without departing from the scope thereof.

What is claimed is:

1. A fixing device for fixing a toner image carried on a sheet-like recording medium, said fixing device comprising:

rotatable means facing each other for fixing the toner image on the recording medium by nipping and conveying said recording medium via a nip of said rotatable means, said rotatable means comprising a rotatable member positioned at a non-fixing side and contacting a non-image surface of said recording medium and a rotatable member positioned at a fixing side and facing said rotatable member positioned at said non-fixing side; and charging means for applying a charge to said rotatable member positioned at the non-fixing side to thereby cause the recording medium to be attracted toward said rotatable member positioned at said non-fixing side by an electrostatic force.

2. The device as claimed in claim 1, further comprising charge applying means for applying a charge opposite in polarity to said rotatable member positioned at the non-fixing side to the recording medium.

3. The device as claimed in claim 2, wherein said charge applying means comprises a conductive member grounded and contacting the recording medium.

4. The device as claimed in claim 3, wherein said conductive member comprises said rotatable member positioned at the fixing side.

5. The device as claimed in claim 1, further comprising peeling means positioned downstream of said nip for electrostatically peeling off the recording medium from said rotatable member positioned at the non-fixing side.

6. The device as claimed in claim 5, wherein said peeling means comprises a charger configured to discharge the recording medium to thereby cause an electrostatic attracting force to decrease or disappear.

7. The device as claimed in claim 5, wherein said peeling means comprises a charger configured to generate an electrostatic repulsive force between the recording medium and said rotatable member positioned at the non-fixing side.

8. The device as claimed in claim 1, further comprising charge applying means for applying a charge to said rotatable member positioned at the non-fixing side from an outside surface of said rotatable member.

9. The device as claimed in claim 1, wherein the charge applied to said rotatable member positioned at the non-fixing side is opposite in polanty to a charge of the toner image.

10. The device as claimed in claim 1, wherein said rotatable member positioned at the non-fixing side has a nonconductive surface layer and a conductive layer inside said nonconductive layer, and the charge is applied to said nonconductive surface layer.

11. The device as claimed in claim 1, wherein a voltage of said charging means is so selected as to exert an electrostatic force capable of separating the recording medium from said rotatable member positioned at the fixing side.

12. The device as claimed in claim 1, further comprising a separating member held in contact with said rotatable member positioned at the fixing side and configured to separate the recording medium from said rotatable member, wherein a voltage of said charging means is so selected as to exert an electrostatic force that allows a contact pressure of said separating member to be lowered.

13. The device as claimed in claim 1, further comprising control means for controlling a voltage of said charging means in accordance with a kind of the recording medium.

14. The device as claimed in claim 13, wherein said control means stores a data table listing a relation between the kind of the recording medium and the voltage beforehand, and selects an optimum voltage out of said data table in accordance with information on the kind of the recording medium input or sensed.

15. The device as claimed in claim 1, wherein said rotatable member positioned at the non-fixing side comprises an endless belt.

16. The device as claimed in claim 15, wherein said endless belt is provided with small thickness and applied with the charge from an inside surface thereof.

17. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to either one of one of said pair of rotatable members and the recording medium;

wherein part of a surface of said one rotatable member at least downstream of the nip attracts the recording medium while part of said surface upstream of said nip is substantially flat.

18. The device as claimed in claim 17, wherein said electrostatic attraction applying means applies either one of a charge and an uneven electric field to said one rotatable member.

19. The device as claimed in claim 17, wherein said electrostatic attraction applying means applies a charge to the recording medium.

20. The device as claimed in claim 17, wherein a non-image surface of the recording medium, not carrying the toner image, is attracted toward the surface of said one rotatable member.

21. The device as claimed in claim 17, wherein an image surface of the recording medium, carrying the toner image, is attracted toward the surface of the recording medium.

22. The device as claimed in claim 17, wherein the recording medium carries toner images on both sides thereof.

23. The device as claimed in claim 17, wherein said one rotatable member comprises an endless belt.

24. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to either one of one of said pair of rotatable members and the recording medium;

wherein part of a surface of said one rotatable member extending from a side upstream of the nip to a side downstream of said nip attracts the recording medium and is substantially flat.

25. The device as claimed in claim 24, wherein said electrostatic attraction applying means applies either one of a charge and an uneven electric field to said one rotatable member.

26. The device as claimed in claim 24, wherein said electrostatic attraction applying means applies a charge to the recording medium.

27. The device as claimed in claim 24, wherein a non-image surface of the recording medium, not carrying the toner image, is attracted toward the surface of said one rotatable member.

28. The device as claimed in claim 24, wherein an image surface of the recording medium, carrying the toner image, is attracted toward the surface of the recording medium.

29. The device as claimed in claim 24, wherein the recording medium carries toner images on both sides thereof.

30. The device as claimed in claim 24, wherein said one rotatable member comprises an endless belt.

31. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members, one of said pair of rotatable members comprising a conductive portion and a non-conductive portion closer to the other rotatable member than said conductive portion; and electrostatic attraction applying means for applying an electrostatic attracting force to said nonconductive portion of said one rotatable member.

32. The device as claimed in claim 31, wherein said electrostatic attraction applying means applies either one of a charge and an uneven electric field to said one rotatable member.

33. The device as claimed in claim 31, wherein a non-image surface of the recording medium, not carrying the toner image, is attracted toward the surface of said one rotatable member.

34. The device as claimed in claim 31, wherein an image surface of the recording medium, carrying the toner image, is attracted toward the surface of the recording medium.

35. The device as claimed in claim 31, wherein the recording medium carries toner images on both sides thereof.

36. The device as claimed in claim 31, wherein said one rotatable member comprises an endless belt.

37. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members, one of said pair of rotatable members comprising an outside surface facing the other rotatable member and an inside surface facing a center of rotation of said one rotatable member; and electrostatic attraction applying means for applying an electrostatic attracting force to the inside surface of said one rotatable member.

38. The device as claimed in claim 37, wherein said electrostatic attraction applying means applies either one of a charge and an uneven electric field to said one rotatable member.

39. The device as claimed in claim 37, wherein a non-image surface of the recording medium, not carrying the toner image, is attracted toward the surface of said one rotatable member.

40. The device as claimed in claim 37, wherein an image surface of the recording medium, carrying the toner image, is attracted toward the surface of the recording medium.

41. The device as claimed in claim 37, wherein the recording medium carries toner images on both sides thereof.

42. The device as claimed in claim 37, wherein said one rotatable member comprises an endless belt.

43. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members;

electrostatic attraction applying means for applying an electrostatic attracting force to one of said pair of rotatable members; and charge applying means for applying a charge to the recording medium.

44. The device as claimed in claim 43, wherein said charge applying means applies a charge opposite in polarity to the toner image to a non-image surface of the recording medium that does not carry said toner image.

45. The device as claimed in claim 43, wherein said electrostatic attraction applying means applies either one of a charge and an uneven electric field to said one rotatable member.

46. The device as claimed in claim 43, wherein a non-image surface of the recording medium, not carrying the toner image, is attracted toward the surface of said one rotatable member.

47. The device as claimed in claim 43, wherein an image surface of the recording medium, carrying the toner image, is attracted toward the surface of the recording medium.

48. The device as claimed in claim 43, wherein said one rotatable member comprises an endless belt.

49. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members; and charge applying means for applying a charge to a non-image surface of the recording medium not carrying the toner image.

50. The device as claimed in claim 49, wherein said charge applying means applies a charge opposite in polarity to the toner image to a non-image surface of the recording medium that does not carry said toner image.

51. The device as claimed in claim 49, wherein a non-image surface of the recording medium, not carrying the toner image, is attracted toward the surface of said one rotatable member.

52. The device as claimed in claim 49, wherein an image surface of the recording medium, carrying the toner image, is attracted toward the surface of the recording medium.

53. The device as claimed in claim 49, wherein said one rotatable member comprises an endless belt.

54. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members;

electrostatic attraction applying means for applying an electrostatic attracting force to either one of one of said pair of rotatable members and the recording medium; and varying means for varying intensity of the electrostatic attracting force.

55. The device as claimed in claim 54, wherein said varying means varies the intensity of the electrostatic attracting force in accordance with a kind of the recording medium.

56. The device as claimed in claim 54, wherein said varying means varies the intensity of the electrostatic attracting force in accordance with any one of a quantity, an area and a thickness of the recording medium.

57. The device as claimed in claim 54, further comprising humidity sensing means for sensing humidity, wherein said varying means varies the intensity of the electrostatic attracting force in accordance with humidity sensed by said humidity sensing means.

58. The device as claimed in claim 54, wherein said electrostatic attraction applying means applies either one of a charge and an uneven electric field to said one rotatable member.

59. The device as claimed in claim 54, wherein said electrostatic attraction applying means applies a charge to the recording medium.

60. The device as claimed in claim 54, wherein a non-image surface of the recording medium, not carrying the toner image, is attracted toward the surface of said one rotatable member.

61. The device as claimed in claim 54; wherein an image surface of the recording medium, carrying the toner image, is attracted toward the surface of the recording medium.

62. The device as claimed in claim 54, wherein the recording medium carries toner images on both sides thereof.

63. The device as claimed in claim 54, wherein said one rotatable member comprises an endless belt.

64. A fixing device for fixing a toner image carried on a sheet-like recording medium, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to at least part of a surface of one of said pair of rotatable members downstream of the nip;

wherein the recording medium is electrostatically attracted toward the part of the surface of said one rotatable member downstream of the nip, but not electrostatically attracted toward part of said surface upstream of said nip.

65. The device as claimed in claim 64, wherein said electrostatic attraction applying means applies either one of a charge and an uneven electric field to said one rotatable member.

66. The device as claimed in claim 64, wherein said electrostatic attraction applying means applies a charge to the recording medium.

67. The device as claimed in claim 64, wherein a non-image surface of the recording medium, not carrying the toner image, is attracted toward the surface of said one rotatable member.

68. The device as claimed in claim 64, wherein an image surface of the recording medium, carrying the toner image, is attracted toward the surface of the recording medium.

69. The device as claimed in claim 64, wherein the recording medium carries toner images on both sides thereof.

70. The device as claimed in claim 64, wherein said one rotatable member comprises an endless belt.

71. In a fixing method for fixing a toner image carried on a sheet-like recording medium by conveying said recording medium via a nip between a pair of rotatable members facing each other, a charge is applied to one of said pair of rotatable members positioned at a non-fixing side, whereby said toner image is fixed on said sheet being attracted toward said one rotatable member by an electrostatic force.

72. The method as claimed in claim 71, wherein the charge, which is opposite in polarity to said one rotatable member, is applied to the recording medium.

73. The method as claimed in claim 71, wherein the charge is applied to said one rotatable member from an outside surface of said rotatable member.

74. The method as claimed in claim 71, wherein the charge, which is opposite in polarity to the toner image, is applied to said one rotatable member.

75. The method as claimed in claim 71, wherein the charge is applied such that the electrostatic force starts acting at a position close to an inlet of the nip.

76. In a fixing method for fixing a toner image carried on a sheet-like recording medium by conveying said recording medium via a nip between a pair of rotatable members facing each other, an electrostatic attracting force is applied to either one of one of said pair of rotatable members positioned at a non-fixing side and said recording medium, whereby said toner image is fixed on said sheet being electrostatically attracted toward said one rotatable member by an electrostatic force.

77. The method as claimed in claim 76, wherein the electrostatic attracting force is varied in accordance with either one of a kind and a condition of the recording medium.

78. In an image forming apparatus for fixing a toner image carded on a sheet-like recording medium by conveying said recording medium via a fixing device, said fixing device comprising:

rotatable means facing each other for fixing the toner image on the recording medium by nipping and conveying said recording medium via a nip of said rotatable means, said rotatable means comprising a rotatable member positioned at a non-fixing side and contacting a non-image surface of said recording medium and a rotatable member positioned at a fixing side and facing said rotatable member positioned at said non-fixing side; and charging means for applying a charge to said rotatable member positioned at the non-fixing side to thereby cause the recording medium to be attracted toward said rotatable member positioned at said non-fixing side by an electrostatic force.

79. The apparatus as claimed in claim 78, wherein when a cover included in a body of said apparatus is opened, a power source assigned to said charging means is automatically turned off.

80. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to either one of one of said pair of rotatable members and the recording medium;

wherein part of a surface of said one rotatable member at least downstream of the nip attracts the recording medium while part of said surface upstream of said nip is substantially flat.

81. The apparatus as claimed in claim 80, wherein when a cover included in a body of said apparatus is opened, a power source assigned to said charging means is automatically turned off.

82. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to either one of one of said pair of rotatable members and the recording medium;

wherein part of a surface of said one rotatable member extending from a side upstream of the nip to a side downstream of said nip attracts the recording medium and is substantially flat.

83. The apparatus as claimed in claim 82, wherein when a cover included in a body of said apparatus is opened, a power source assigned to said charging means is automatically turned off.

84. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members, one of said pair of rotatable members comprising a conductive portion and a nonconductive portion closer to the other rotatable member than said conductive portion; and electrostatic attraction applying means for applying an electrostatic attracting force to said nonconductive portion of said one rotatable member.

85. The apparatus as claimed in claim 84, wherein when a cover included in a body of said apparatus is opened, a power source assigned to said charging means is automatically turned off.

86. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members, one of said pair of rotatable members comprising an outside surface facing the other rotatable member and an inside surface facing a center of rotation of said one rotatable member; and electrostatic attraction applying means for applying an electrostatic attracting force to the inside surface of said one rotatable member.

87. The apparatus as claimed in claim 86, wherein when a cover included in a body of said apparatus is opened, a power source assigned to said charging means is automatically turned off.

88. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members;

electrostatic attraction applying means for applying an electrostatic attracting force to one of said pair of rotatable members; and charge applying means for applying a charge to the recording medium.

89. The apparatus as claimed in claim 88, wherein when a cover included in a body of said apparatus is opened, a power source assigned to said charging means is automatically turned off.

90. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members; and charge applying means for applying a charge to a non-image surface of the recording medium not carrying the toner image.

91. The apparatus as claimed in claim 90, wherein when a cover included in a body of said apparatus is opened, a power source assigned to said charging means is automatically turned off.

92. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members;

electrostatic attraction applying means for applying an electrostatic attracting force to either one of one of said pair of rotatable members and the recording medium; and varying means for varying intensity of the electrostatic attracting force.

93. The apparatus as claimed in claim 92, wherein when a cover included in a body of said apparatus is opened, a power source assigned to said charging means is automatically turned off.

94. In an image forming apparatus for fixing a toner image carried on a sheet-like recording medium by conveying said recording medium via a fixing device, said fixing device comprising:

a pair of rotatable members facing each other for fixing the toner image on the recording medium by pressing and conveying said recording medium via a nip of said pair of rotatable members; and electrostatic attraction applying means for applying an electrostatic attracting force to at least part of a surface of one of said pair of rotatable members downstream of the nip;

wherein the recording medium is electrostatically attracted toward the part of the surface of said one rotatable member downstream of the nip, but not electrostatically attracted toward part of said surface upstream of said nip.

95. The apparatus as claimed in claim 94, wherein when a cover included in a body of said apparatus is opened, a power source assigned to said charging means is automatically turned off.

96. An image forming apparatus comprising:

an image carrier configured to transfer a toner image to a recording medium; and a fixing device configured to receive the recording medium from the image carrier and including, a conveying member a charger configured to apply an electrostatic attracting force to the conveying member, and a processing unit configured to vary an intensity of the electrostatic attracting force.

97. A method for fixing a toner image on a recording medium, comprising:

forming a nip between a first rotatable member and a second rotatable member, the second rotatable member being positioned at a non-fixing side;

conveying the recording medium via the nip;

applying a charge to the second rotatable member such that the recording medium is attracted to the second rotatable member by an electrostatic force; and fixing the toner image on the recording medium while the recording medium is attracted to the second rotatable member.

98. The method of claim 97, wherein applying a charge includes applying a charge to the recording medium that is opposite in polarity to the second rotatable member.

99. The method of claim 97, wherein applying a charge includes applying the charge to an outer surface of the second rotatable member.

100. The method of claim 97, wherein applying a charge includes applying a charge to the recording medium that is opposite in polarity to the toner image.

101. The method of claim 97, wherein applying a charge includes applying the charge such that the electrostatic force begins to act at a position close to an inlet of the nip.

* * * * *